US005188009A

United States Patent [19]

Sunohara et al.

[11] Patent Number: 5,188,009

[45] Date of Patent: Feb. 23, 1993

[54] METHOD FOR CHANGING THE DIRECTION OF A CUTTER EDGE OF A CUTTING PLOTTER

[75] Inventors: Ichiro Sunohara; Tatsuji Ikeda, both of Nagano, Japan

[73] Assignee: Mimaki Engineering Co., Ltd., Nagano, Japan

[21] Appl. No.: 638,522

[22] Filed: Jan. 10, 1991

[30] Foreign Application Priority Data

Jul. 11, 1989 [JP] Japan ..... 1-178461

[51] Int. Cl.[5] ..... B26D 5/30

[52] U.S. Cl. ..... 83/13; 83/56; 83/76.1; 83/939

[58] Field of Search ..... 83/13, 56, 76.1, 76.6, 83/76.7, 76.8, 76.9, 938-941, 936, 937

[56] References Cited

U.S. PATENT DOCUMENTS 3,735,660 5/1973 Pearl ..... 83/940 X 3,766,813 10/1973 Pearl ..... 83/941 X

*Primary Examiner*—Douglas D. Watts

*Assistant Examiner*—Eugenia A. Jones

*Attorney, Agent, or Firm*—Wenderoth, Lind & Ponack

[57] ABSTRACT

A method for changing the direction of a cutting edge of a cutting plotter in order to align the cutting edge in the direction in which the initial portion of the desired cut will be made, prior to beginning a cut in the effective plotting area of a sheet mounted on a recording surface. By preliminarily aligning the cutting edge along the cutting direction, the cut can be made accurately along, for example, a straight line from the starting point of the cut. The method is performed with a cutting blade with a main edge directed diagonally upwardly from a cutting point, the cutting blade being rotatably supported in a holder for rotation around its axial center. The edge of the cutter can be aligned in a certain direction by first pressing the blade against a non-used portion of the sheet and moving the cutter therealong in a predetermined direction to cause rotation of the main edge of the cutter in the holder to align it in a first predetermined direction. Then, the cutter is raised from the marginal portion of the sheet, moved to a position over the cut-starting point of the effective plotting area of the sheet, and lowered such that the cutting point of the blade is pressed against the sheet at the cut-starting point. Finally, the cutter is moved relative to the sheet in order to cause the blade to pivot about its cutting point by a predetermined angle until it is aligned in the predetermined desired cutting direction.

9 Claims, 5 Drawing Sheets

METHOD FOR CHANGING THE DIRECTION OF A CUTTER EDGE OF A CUTTING PLOTTER

BACKGROUND OF THE INVENTION

The present invention relates to a method for changing the direction of an edge of a cutter mounted on a pen carriage of a cutting plotter, so as to align the edge of the cutter in the proper direction for cutting.

Conventionally, a so-called cutting plotter has been known, in which a cutter is mounted on a pen carriage and is relatively movable in the X-Y direction on a sheet placed on the recording plane.

In this plotter, the cutter mounted on the pen carriage is arranged as shown in FIG. 8. Specifically, a cutting blade 54 having a knife edge 52 directed diagonally upwardly from its cutting tip or point is supported within a holder 56 for rotation about its axial center 58. With the edge 52 of the cutter pressed against a sheet placed on a recording plane, the pen carriage with the cutter 50 is relatively moved in the X-Y direction along the sheet. During cutting of the sheet surface, the main edge 54 of the cutter rotates in the holder 56 around the axial center 58 until the edge 52 of the blade 54 is directed toward the cutting direction.

When cutting in the effective plotting area 12 (i.e. the area on the inner portion of the sheet to be used by the user) of the sheet placed on the recording plane is cut by the cutter mounted in the cutting plotter, the initial portion of the cut will not be linear (as shown in FIG. 8 by broken line 16), but will rather be along a curved line (as shown by solid line 18), assuming that the edge 52 of the blade 54 was not per chance initially aligned along the cutting direction.

The reason for this is that, when the cutting is started on the surface of the above area 12, the edge 52 of the above cutter is normally not aligned in the cutting direction. Therefore, during the initial portion of the cut by the above cutter 50, the blade 54 of the cutter is forced to rotate in the holder 56 about the axial center 58 as the cutter 50 is moved in the cutting direction, such that the edge 52 of the blade 54 is gradually turned toward the cutting direction. Because of this initial "period of alignment" of the edge 52 with the desired cutting direction, the initial portion of the cut will vary from the line along which the cut should have been made. FIG. 8 shows the example where it was desired to make a straight cut (broken line 16) in the downward direction, but because the edge 52 of the blade was not initially aligned in the cutting direction, the initial portion of the cut is undesirably curved (solid line 18).

SUMMARY OF THE INVENTION

The object of the present invention is to provide a method for changing the direction of an edge of a blade of a cutting plotter (hereinafter referred as "changing method"), by which it is possible to change the direction of the cutter edge prior to making a cut in the sheet, so that the cut will be accurate along the desired cutting direction even along the initial portion of the cut.

To attain the above object, the first changing method utilizes a cutter having a cutting blade with a knife edge which extends diagonally upwardly from its cutting point, the blade being rotatably supported in a holder about its axial center. The cutter is mounted on a pen carriage which is relatively movable in the X-Y direction over a sheet placed on a recording plane. In the method, from a position in which the cutting point of the edge of the blade is pressed against the surface of the sheet outside of the effective plotting area of the sheet, the pen carriage is moved relative to the sheet along a first predetermined path so as to move the blade over the sheet, while cutting the surface of the sheet, until the edge of the blade is directed toward a first predetermined direction. Then, with the holder in a raised position, the pen carriage is moved to a position in which the cutting point of the blade is pressed against the sheet at the point at which the cut is to be initiated. Prior to initiating the cutting of the surface of the sheet in the effective plotting area, the pen carriage is moved relative to the sheet along a second predetermined path which depicts a circular arc, such that the edge of the blade is forced to rotate in the holder by a predetermined angle, until the edge of the blade is aligned in a second predetermined direction, which is the direction along which the initial portion of the desired cut is to be made.

The second changing method of this invention utilizes a cutter having a cutting blade with a knife edge which is directed diagonally upwardly from its cutting point, the blade being rotatably supported in a holder about its axial center. The cutter is mounted on a pen carriage which is relatively movable in the X-Y direction over a sheet placed on a recording plane. A dead area, against which the edge of the blade is adapted to be pressed, is furnished on a part of the recording plane outside the site where the sheet is placed. When the edge of the blade is pressed against this dead area, the pen carriage is moved along a first predetermined path, so as to move the blade over the dead area until the edge of the blade is directed in a first predetermined direction. Then, with the holder in a raised position, the pen carriage is moved to a position in which the cutting point of the blade is pressed against the sheet at the point at which the cut is to be initiated. Prior to initiating the cutting of the surface of the sheet in the effective plotting area, the pen carriage is moved relative to the sheet along a second predetermined path which depicts a circular arc, until the edge of the blade is aligned in a second predetermined direction, which is the direction along which the initial portion of the desired cut is to be made.

Thus, in the first and the second changing methods as described above, the edge of the blade can be effectively positioned such that it is directed toward the direction in which the cut is to be initiated in the effective plotting area prior to initiation of the cut.

In the Figures, 10 represents a sheet, 12 an effective plotting area, 14 a sheet portion, 15 a point at which a cut is to be initiated (i.e. a starting point), 20 a recording plane, 30 a feeding means, 40 a pen carriage, 50 a cutter, 52 a knife edge, 54 a cutting blade, 56 a holder, and 60 a dead area.

DETAILED DESCRIPTION OF THE PREFERRED EMBODIMENT

Figure 3:
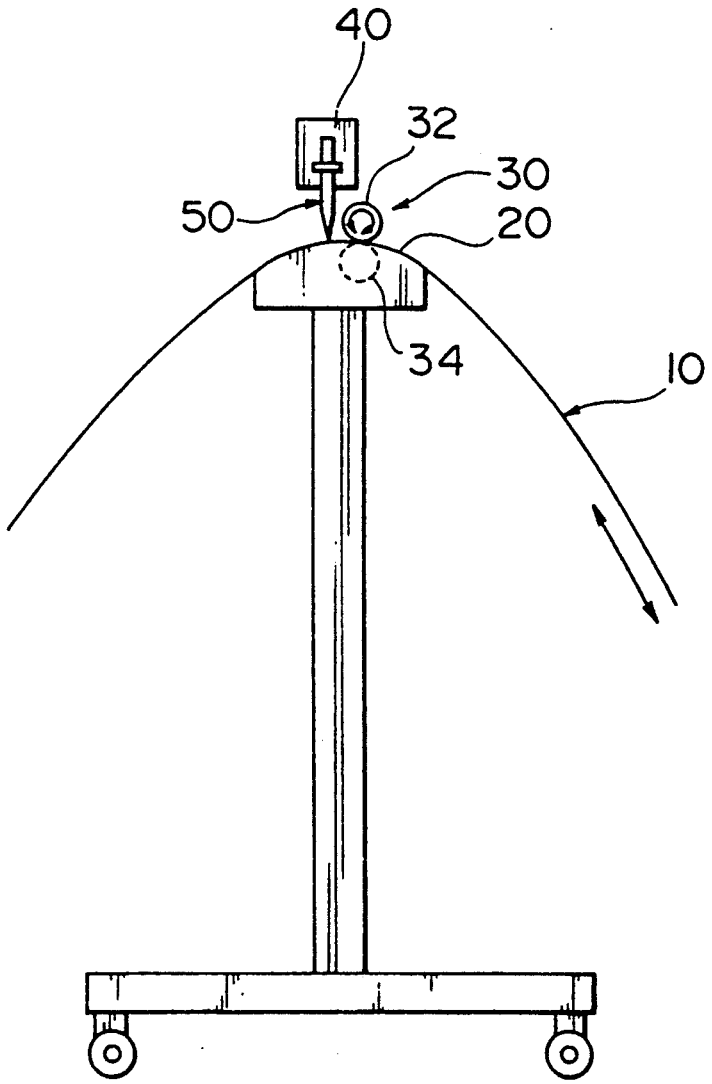
FIG. 3 is a side view schematically showing the structure of a vertical type cutting plotter which can be used in the first and the second changing methods of this invention.

FIG. 3 shows a plotter, which is a so-called vertical type cutting plotter.

Figure 7:
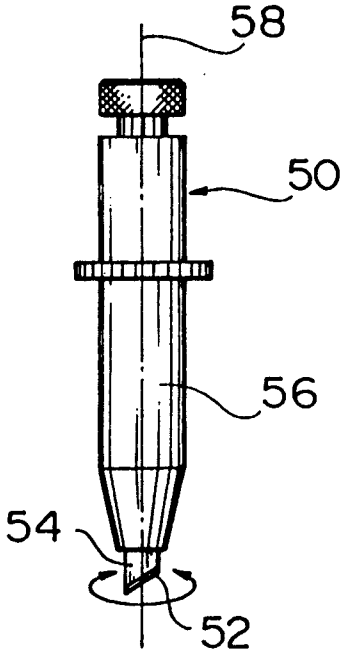
FIG. 7 PRIOR ART
FIG. 7 is a front view of a prior art cutter which can be used in the method of the present invention.

This plotter comprises a recording plane 20 having a semi-cylindrical cross-section upon which the sheet 10 is placed, a feeding means 30 for moving the sheet 10 rearwardly and forwardly (i.e. in the Y direction) along the recording plane 20, and a pen carriage 40 which is movable leftwardly and rightwardly (i.e. in the X direction) along the surface of the recording plane 20. The feeding means 30 includes a pinch roller 32 and a driving roller 34, and the pen carriage 40 is provided with a cutter 50 for cutting the surface of the sheet 10 (see FIG. 7), and a lifting means (not shown) for lowering and pressing the cutter 50 mounted on the pen carriage against the surface of the sheet 10 placed on the recording plane 20 or for lifting it above the sheet 10. The cutter 50 includes a holder 56, and a cutting blade 54 rotatably mounted in the holder 56 about axis 58 and having a knife edge 54 extending diagonally upwardly from a cutting point thereof.

Further, this plotter is provided with a CPU (central processing unit) for controlling the driving means (not shown), such as a motor or actuator for driving the pen carriage 40, or feeding means 30, and with a computer (not shown) for issuing commands to the CPU. The CPU is operated according to a program input into the computer, such that the pen carriage 40, the feeding means 30, and the lifting means can be automatically controlled in the manner described below.

With this plotter, it is possible to cut the surface of the sheet 10 when the pen carriage 40 is moved in the X direction and the sheet 10 is moved in the Y direction after the cutter 50 has been lowered and pressed against the surface of the sheet 10 on the recording plane 20 by way of the lifting means.

The following is a detailed description of a first changing method for using the cutting plotter to cut the sheet surface, by operating the CPU according to the program input into the computer.

Figure 1:
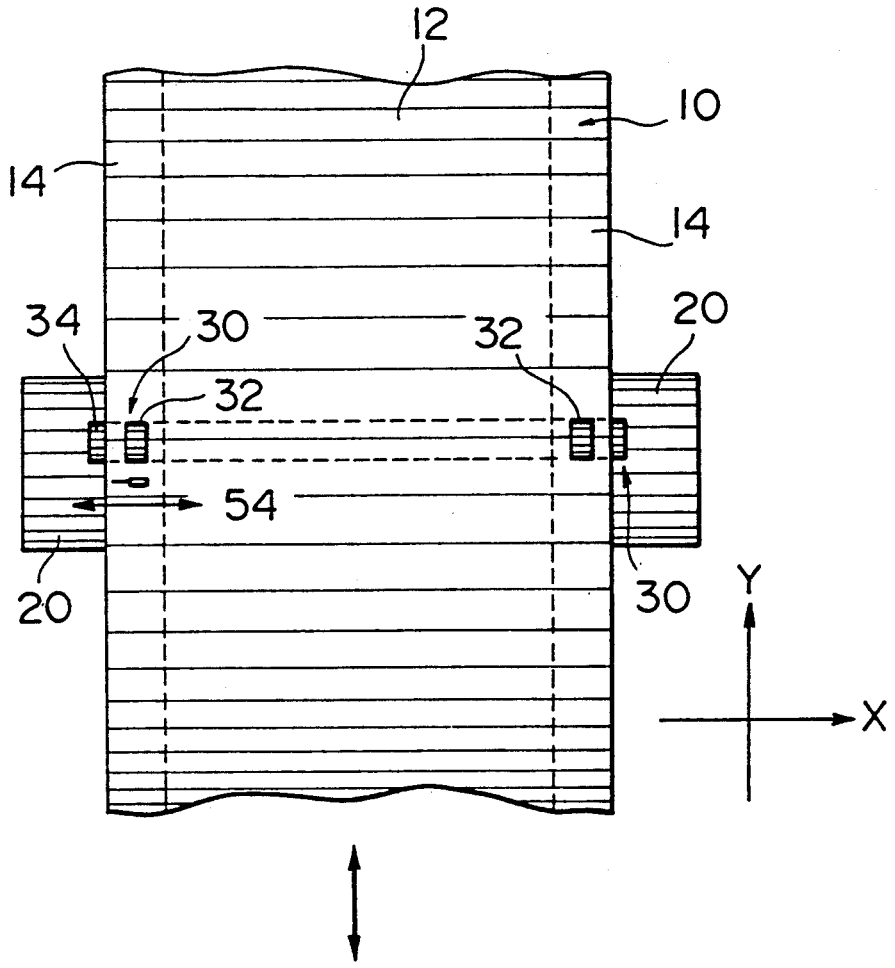
FIG. 1 is a plan view of a vertical type cutting plotter to be used in a first changing method of the invention with a sheet placed on a recording plane of the plotter.
Figure 2:
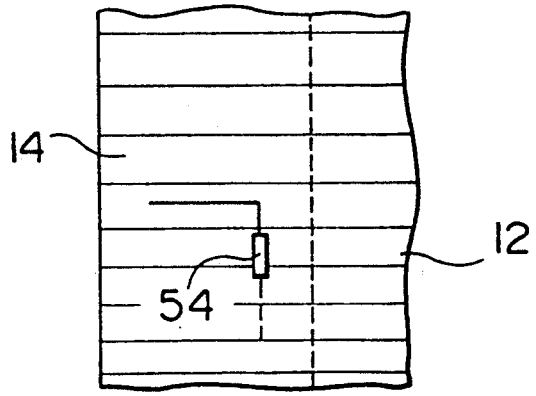
FIG. 2 is an enlarged view of a portion of the sheet of FIG. 1.

The blade 54 of the cutter 50 mounted on the pen carriage is lowered such that the cutting point of the blade 54 is pressed against the surface of the sheet 14 on a marginal portion thereof disposed outwardly of the effective plotting area 12 of the sheet 10 placed o the recording plane 20 (i.e. against a portion of the sheet 14 which will not be used in cutting a desired pattern. The pen carriage 40 is then moved relative to the marginal portion of the sheet along a predetermined path, while cutting the sheet 10, until the edge 54 is aligned in a first predetermined direction (e.g. the X direction in FIG. 1), due to rotation of the blade 54 in the holder 56.

Next, after the cutter 50 has been lifted above the sheet 10 by the lifting means, the pen carriage 40 is moved a predetermined amount in the X direction and the sheet 10 is moved a predetermined amount in the Y direction over the recording plane 20 by the feeding means 30, until the cutter 50 mounted on the pen carriage is positioned immediately above the cut-starting point 15 on the effective plotting area of the sheet. Next, the cutter 50 is lowered by the lifting means until the cutting point of the blade 54 is pressed against the surface of the above cut-starting point 15. With the cutting point of the blade 54 of the cutter 50 pressed against the surface of the cut-starting point 15, the pen carriage 40 is moved in the X direction by a predetermined distance, and the sheet 10 is moved in the Y direction by a predetermined distance, in order to cause the pen carriage 40 to move, relative to the sheet 10, along a predetermined path, in particular a circular arc 17 (e.g. see FIG. 5). Note, however, that if the edge 52 of the blade 54 is already directed toward the cut-starting direction prior to this movement of the pen carriage 40 relative to the sheet 10, the relative movement will be zero. Such relative movement of the pen carriage 40 with the cutter 50 mounted thereon causes the blade 54 to be rotated by a desired angle within the holder and about the cutting point (cutting tip) of the blade 54, such that the edge 52 of the blade 54, with the cutting point pressed against the surface of the starting point 15, becomes aligned with the direction of the initial portion of the desired cut.

Figure 4:
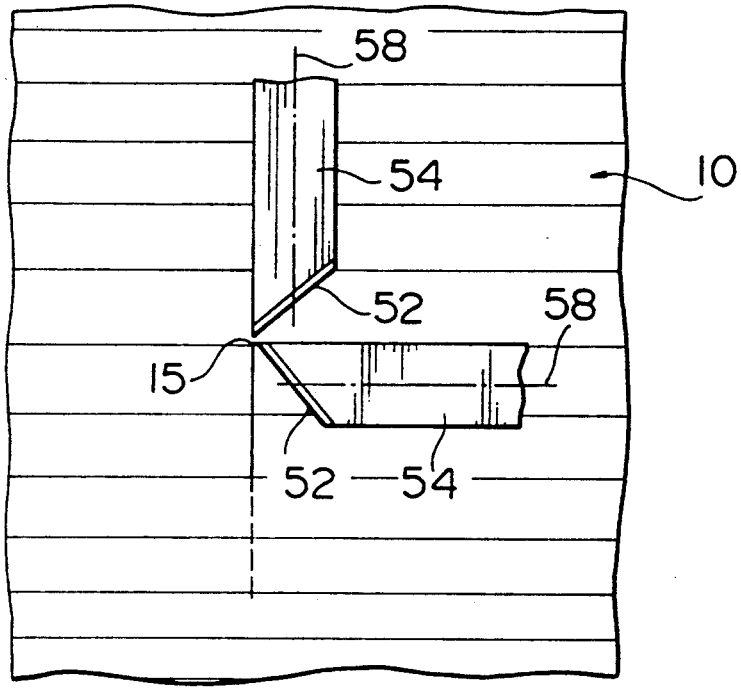
FIG. 4 is a schematic drawing for explaining the rotation of the blade within the holder at a point at which a cut is to be initiated.
Figure 5:
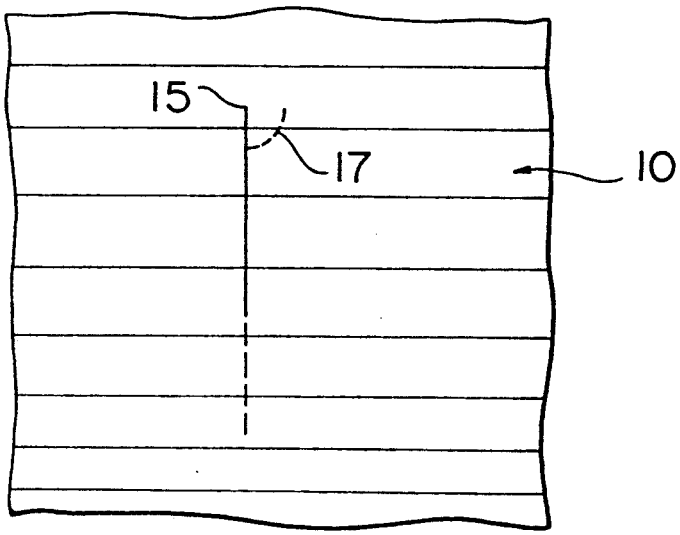
FIG. 5 is a plan view showing the path of the axial center of the blade upon being rotated as depicted in FIG. 4.

This rotation of the blade 54 in the holder 56 will now be explained in more detail with reference to FIGS. 4 and 5. Note that FIG. 4 shows the blade 54 of the cutter as being laid down on the surface of the sheet 10. This is merely a schematic depiction for explaining the rotation of the blade and in actuality the blade 54 extends normal to the sheet 10. The edge 52 of the blade 54 is directed diagonally upwardly from the cutting point (or cutting tip) of the blade 54, such that the cutting point is offset from the axial center 58 of the blade 54 by a predetermined distance. Therefore, when the pen carriage 40 provided with the cutter 50 (and thus the axial center 58) is moved relative to the sheet 10 as if to depict a circular arc 17, with the cutting tip of the blade 54 pressed against the surface of the sheet 10 at the cut-starting point 15, the blade 54, and thus the axial center 58, is forced to rotate by the desired angle about a pivot point provided by the cutting point. The relative route of the axial center 58 of the blade 54 in relation to the sheet 10 is as shown by the broken line 17 in FIG. 5, which depicts a circular arc.

Then, the pen carriage 40 is moved in the X direction, and the sheet 10 is moved by the feeding means 30 in the Y direction over the recording plane 20, such that with the cutting point of the edge 52 of the blade 54 pressed against the surface of the effective plotting area 12 of the sheet, the surface of the area 12 can be cut in a desired shape.

With the above described method in which the surface of the effective plotting area 12 can be cut as described above, the surface of the effective plotting area 12 of the sheet can be accurately cut, for example, along a straight line, because the edge 52 of the blade 54 is directed toward the direction of the initial portion of the desired cut from the time when the cut is initiated.

In the above first changing method, when the marginal sheet portion 14 outside the effective plotting are of the sheet is cut, it is preferable to make the cut in an elongated L-shape. The reason for this is that, because the outside (or marginal) portions of the sheet 10 are normally relatively narrow, a straight line cut will have to be kept short to avoid cutting into the plotting area 12. Because the cut must be kept short, it is quite possible that the blade 54 of the cutter will not be completely rotated within the holder 56 before the cut is completed. If this occurs, the edge 52 of the blade 54 will not be completely directed toward the first predetermined direction. By making the cut in an L-shape, such rotation of the blade 54 is facilitated, such that the edge 52 can be aligned in the first predetermined direction without having the cut extend into the plotting area 12.

Figure 6:
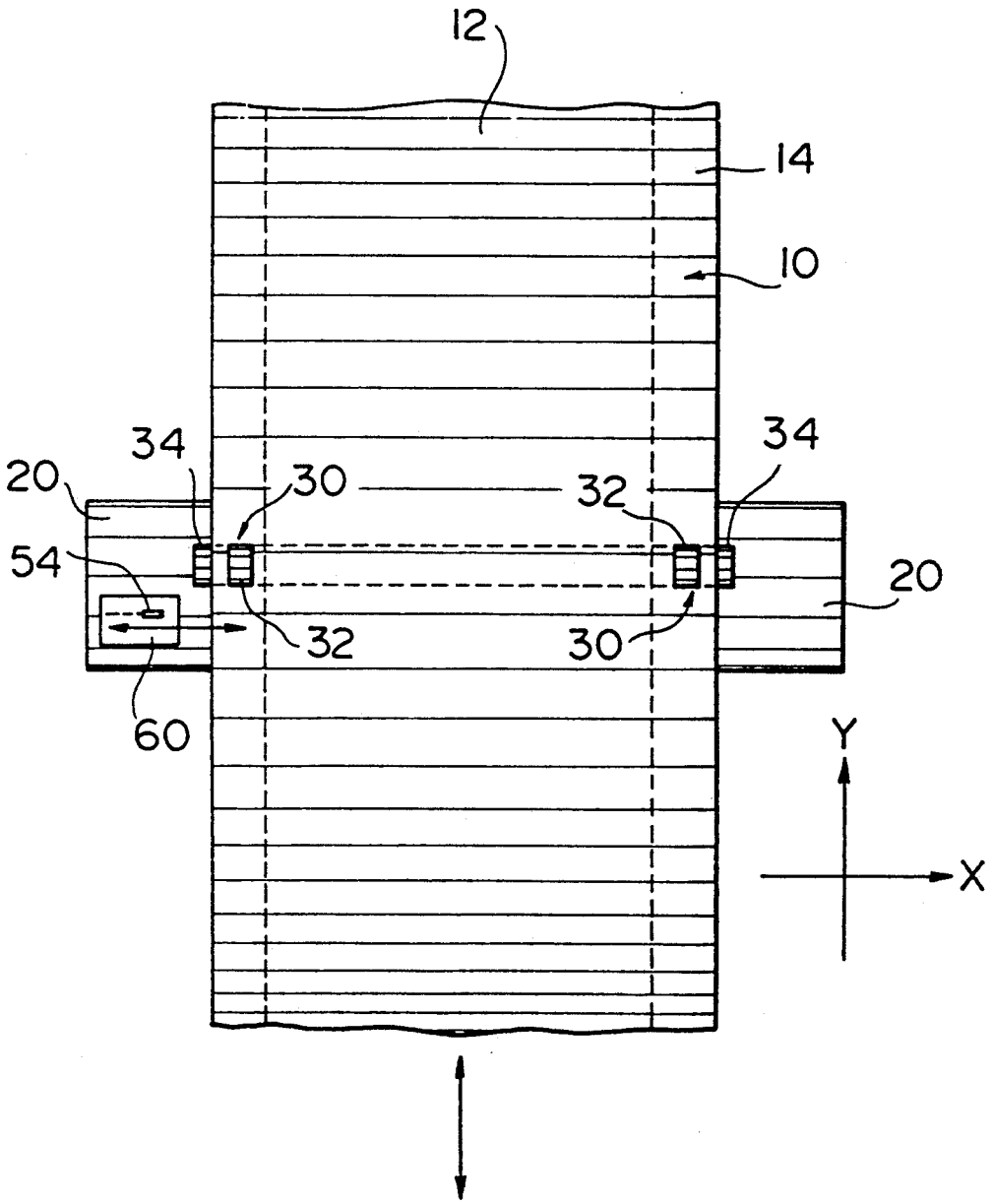
FIG. 6 is a plan view of the sheet placed on the recording plane of a vertical type cutting plotter, in accordance with the second changing method of this invention.

FIG. 6 shows a preferred embodiment of the cutting plotter to be used in the second changing method of this invention. It is a plan view showing the sheet placed on the recording plane. The following is a description of this embodiment.

The plotter in this figure is a vertical typetype cutting plotter, similar to the plotter of FIG. 3.

This plotter is provided with a planar dead area 60 made of urethane rubber, against which the knife edge 52 of the cutter 50 can be repeatedly pressed when the pen carriage is moved to positions outside of the effective plotting area of the sheet.

The following is a description of the method for cutting the sheet according to the second changing method of this invention by operating the CPU according to the program input into the computer.

With the cutter 50 lifted above the sheet 10, the pen carriage 40 is moved in the X direction in order to position the pen carriage 40 immediately above the dead area 60, and then the cutter on the pen carriage is lowered and pressed against the surface of the dead area 60 by the lifting means. The pen carriage 40 can then be moved in the X-direction along the surface of the above dead area 60 to cause the main edge 54 of the cutter to rotate within the holder 56, in order to align the edge 52 of the cutter in a first predetermined direction (X direction in the figure).

Next, by the same procedure as in the first changing method, the pen carriage 40 is moved in the X direction with the cutter 50 lifted above the sheet 10 and the sheet 10 is moved in the Y direction along the recording plane 20, in order to position the cutter 50 on the pen carriage immediately above the cut-starting position on the effective plotting area 12 of the sheet. Further, by the same procedure as in the first changing method, the cutter 50 on the pen carriage is lowered and pressed against the surface of the sheet at the cut-starting point by the lifting means. Then, the pen carriage 40 is relatively moved over the sheet 10 as if to depict a circular arc. As above, if the edge 52 of the cutter is already aligned along the desired cutting direction, the relative movement of the pen carriage over the sheet 10 will be zero. Thus, the main edge 54 of the cutter is rotated within the holder 56 by the desired angle such that the edge of the cutter is directed toward the direction to start the cutting of the surface of the effective plotting area 12.

Thereafter, by the same procedure as in the first changing method, the cutter 50 is pressed on the surface of the effective plotting area 12, and the pen carriage 40 is relatively moved in the X-Y direction over the surface of the effective plotting area 12 of the sheet, in order to cut the desired pattern in the sheet.

Figure 8:
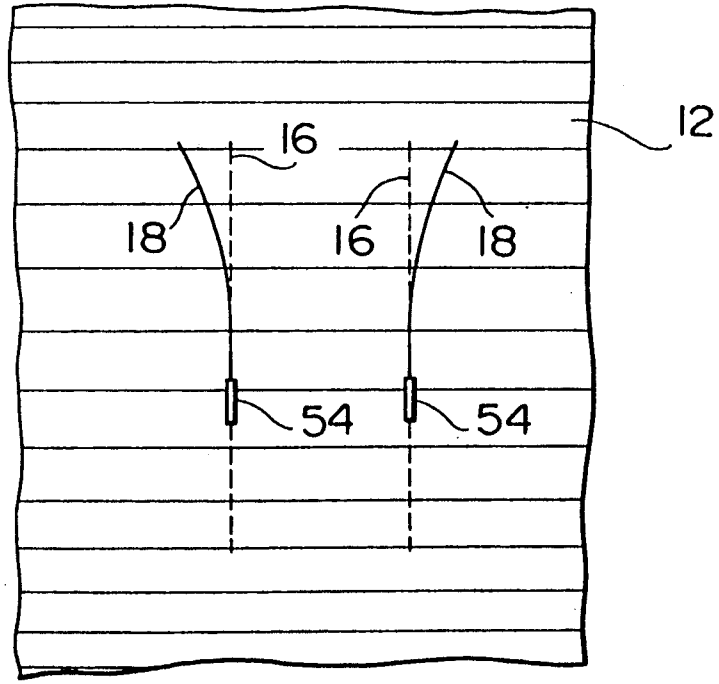
FIG. 8 PRIOR ART
FIG. 8 is a plan view of the surface of the effective plotting area of a sheet, illustrating the conventional cutting method.

Like the case of the first changing method as described above, according to the second changing method, the edge 52 of the cutter on the pen carriage is directed toward the direction to start the cutting of the surface of the effective plotting area 12 from the time when the cutting of the surface of the effective plotting area 12 has been started. Accordingly, the surface of the above area 12 can be accurately cut along a desired path (e.g. along a straight line as shown by broken line 16 in FIG. 8).

In the first and the second changing methods as described above, the pen carriage can be provided with a plurality of various types of cutters. It is needless to say that these methods can be applied to a cutting plotter in which the cutter mounted on the pen carriage can be automatically replaced with various types of cutters accommodated in the above pen magazine, or to a cutting plotter in which the cutter mounted on the pen carriage cannot be automatically replaced with various types of other cutters.

The first and the second changing methods of this invention can also be applied to the so-called horizontal type plotter, which comprises a wide and planar recording plane provided with a sheet, a pen carriage moving in the X-Y direction over the recording plane, i.e. a pen carriage provided with a cutter for cutting the sheet surface, and a lifting means for lifting and lowering the cutter on the pen carriage.

As described above, it is possible according to the first and the second changing methods of this invention, to cut the surface of the effective plotting area of a sheet placed on a recording plane of a cutting plotter with the cutter mounted on the pen carriage, so as to accurately cut a desired shape, such as along straight line, from the starting point of the cut.

With the above methods, the cutting plotter can beautifully cut the surface of the effective plotting area of the sheet in the desired shape without substantial error, in accordance with the program input into the computer.

We claim:

1. A method of preparing to cut a predetermined pattern in a sheet which is mounted on a recording plane of a cutting plotter such that the sheet includes an effective plotting area and such that a non-use area is defined on the recording plane outside of the effective plotting area, the cutting plotter including a pen carriage, and a cutter having a holder and a knife blade rotatably mounted in the holder for rotation about a central axis thereof, the knife blade including a knife edge extending diagonally upwardly from a cutting tip, said method comprising the steps of:

moving the pen carriage so as to press the cutting tip of the knife edge against the recording plane in the non-use area;

with the cutting tip of the knife edge pressed against the recording plane in the non-use area, moving the cutter in the non-use area relative to the recording plane until the knife edge is aligned in a first predetermined direction;

raising the pen carriage so that the cutting tip of the knife edge is raised above the recording plane;

moving the pen carriage relative to the sheet to a position over the effective plotting area in which the cutting tip of the knife edge is positioned directly above a starting point of a predetermined prospective cut which will extend from the starting point in a second predetermined direction;

lowering the pen carriage so that the cutting tip of the knife edge processes against the sheet at the starting point; and with the cutting tip of the knife edge pressed against the sheet at the starting point, moving the pen carriage relative to the sheet such that the cutting tip of the knife edge will remain at the starting point and the knife edge will pivot about the starting point with the cutting tip as a pivot until the knife edge becomes aligned in the second predetermined direction.

2. A method as recited in claim 1, wherein the sheet covers at least a portion of the non-use area, such that, in said step of moving the cutter in the non-use area, the knife blade cuts a portion of the sheet outside of the effective plotting area.

3. A method as recited in claim 1, wherein a dead area is provided on the recording plane in the non-use area; and in said step of moving the pen carriage so as to press the cutting tip of the knife edge against the recording plane in the non-use area, the cutting tip of the knife edge is pressed against the dead area.

4. A method as recited in claim 3, wherein in said step of moving the cutter in the non-use area, the cutter is moved so that the cutting tip of the knife edge is maintained against the dead area.

5. A method as recited in claim 4, wherein the dead area is formed of urethane rubber.

6. A method as recited in claim 3, wherein the dead area is formed of urethane rubber.

7. A method of preparing to cut a predetermined pattern in a sheet which is mounted on a recording plane of a cutting plotter such that the sheet includes an effective plotting area and a marginal area outside of the effective plotting area, the cutting plotter including a pen carriage, and a cutter having a holder and a knife blade rotatably mounted in the holder for rotation about a central axis thereof, the knife blade including a knife edge diagonally upwardly from the cutting tip, said method comprising the steps of:

moving the pen carriage so as to press the cutting tip of the knife edge against the sheet in the marginal area;

with the cutting tip of the knife edge pressed against the sheet in the marginal area, moving the cutter in the marginal area relative to the sheet until the knife edge is aligned in a first predetermined direction;

raising the pen carriage so that the cutting tip of the knife edge is raised above the sheet;

moving the pen carriage relative to the sheet t a position over the effective plotting area in which the cutting tip of the knife edge is positioned directly above a starting point of a predetermined prospective cut which will extend from the starting point in a second predetermined direction;

lowering the pen carriage so that the cutting tip of the knife edge presses against the sheet at the starting point; and with the cutting tip of the knife edge pressed against the sheet at the starting point, moving the pen carriage relative to the sheet such that the cutting tip of the knife edge will remain at the starting point and the knife edge will pivot about the starting point with the cutting tip as a pivot until the knife edge becomes aligned in the second predetermined direction.

8. A method of preparing to cut a predetermined pattern in a sheet which is mounted on a recording plane of a cutting plotter such that the sheet includes an effective plotting area, a dead area being provided on the recording plane outside of the effective plotting area, the cutting plotter including a pen carriage, and a cutter having a holder and a knife blade rotatably mounted in the holder for rotation about a central axis thereof, the knife blade including a knife edge extending diagonally upwardly from a cutting tip, said method comprising the steps of:

moving the pen carriage so as to press the cutting tip of the knife edge against the dead area;

with the cutting tip of the knife edge pressed against the dead area, moving the cutter in the dead area relative to the recording plane until the knife edge is aligned in a first predetermined direction;

raising the pen carriage so that the cutting tip of the knife edge is raised above the dead area;

moving the pend carriage relative to the sheet to a position over the effective plotting area in which the cutting tip of the knife edge is positioned directly above a starting point of a predetermined prospective cut which will extend from the starting point in a second predetermined direction;

lowering the pen carriage so that the cutting tip of the knife edge presses against the sheet at the starting point; and with the cutting tip of the knife edge pressed against the sheet at the starting point, moving the pen carriage relative to the sheet such that the cutting tip of the knife edge will remain at the starting point and the knife edge will pivot about the starting point with the cutting tip as a pivot until the knife edge becomes aligned in the second predetermined direction.

9. A method as recited in claim 8, wherein the dead area is formed of urethane rubber.

* * * * *